US010413082B2

(12) United States Patent
Lava et al.

(10) Patent No.: US 10,413,082 B2
(45) Date of Patent: Sep. 17, 2019

(54) ZIP ON UPHOLSTERY

(71) Applicant: A. Lava & Son Co., Chicago, IL (US)

(72) Inventors: Adam Lava, Chicago, IL (US); Jim McCarthy, Chicago, IL (US)

(73) Assignee: A. Lava & Son Co., Chicago, IL (US)

( * ) Notice: Subject to any disclaimer, the term of this patent is extended or adjusted under 35 U.S.C. 154(b) by 455 days.

(21) Appl. No.: 15/172,779

(22) Filed: Jun. 3, 2016

(65) Prior Publication Data

US 2016/0353907 A1 Dec. 8, 2016

Related U.S. Application Data

(60) Provisional application No. 62/171,796, filed on Jun. 5, 2015.

(51) Int. Cl.
*A47C 31/10* (2006.01)
*A47C 27/00* (2006.01)

(52) U.S. Cl.
CPC ..... *A47C 31/105* (2013.01); *A47C 27/001* (2013.01); *A47C 27/002* (2013.01)

(58) Field of Classification Search
CPC ..... A47C 27/00; A47C 27/001; A47C 27/002; A47C 27/003; A47C 27/005; A47C 27/006; A47C 27/007; A47C 27/008; A47C 31/007; A47C 31/10; A47C 31/105
USPC ..... 5/737, 738
See application file for complete search history.

(56) References Cited

U.S. PATENT DOCUMENTS 2,154,910 A * 4/1939 Magaril ..... A47C 27/05 5/722
2,400,731 A * 5/1946 Armstrong ..... A47C 27/006 150/154
3,027,573 A * 4/1962 Bell, Jr. ..... A47C 27/22 5/500
3,493,980 A * 2/1970 Haller ..... A47C 27/04 5/699
5,910,081 A * 6/1999 Graham ..... A47C 31/105 5/699
5,966,759 A * 10/1999 Sanders ..... A47C 27/007 5/497
7,181,797 B2 2/2007 Chase
7,452,131 B2 * 11/2008 Kettner ..... B65D 33/2541 24/585.12
8,904,581 B2 12/2014 Rabbany et al.
2002/0148047 A1 * 10/2002 Corzani ..... A47C 27/006 5/738
2003/0124928 A1 * 7/2003 Sherrod ..... A47C 27/006 442/76
2004/0255387 A1 * 12/2004 England ..... A47C 27/04 5/728
2005/0063621 A1 * 3/2005 Kettner ..... B65D 33/2541 383/63
2012/0117728 A1 5/2012 O'Neill
(Continued)

OTHER PUBLICATIONS

"Thestitchsharer", How to Make a Piped Cushion Cover with a Zipper Opening, Apr. 13, 2014. (Year: 2014).*
(Continued)

*Primary Examiner* — Robert G Santos
(74) *Attorney, Agent, or Firm* — McDonnell Boehnen Hulbert & Berghoff LLP

(57) ABSTRACT

Mattress covers are disclosed that enable a user to provide a distinct consumer marketing appearance to a mattress.

11 Claims, 9 Drawing Sheets

(56) References Cited

U.S. PATENT DOCUMENTS

| | | | | |
|---|---|---|---|---|
| 2012/0137434 | A1* | 6/2012 | Dusaj | A47C 31/007 5/499 |
| 2013/0025067 | A1 | 1/2013 | Ober | |
| 2014/0082843 | A1 | 3/2014 | Papadakos | |
| 2015/0182032 | A1 | 7/2015 | Jensen et al. | |
| 2016/0353907 | A1* | 12/2016 | Lava | A47C 31/105 |

OTHER PUBLICATIONS

A&E, Minimizing Seam Puckering, Feb. 5, 2010, A&E Technical Bulletin. (Year: 2010).*

Holly, Tutorial: Six Seam Finishes (And When to Use Them), Mar. 7, 2013, Megan Nielsen Design Diary. (Year: 2013).*

* cited by examiner

ZIP ON UPHOLSTERY

CROSS-REFERENCE TO RELATED APPLICATIONS

This application claims the benefit of U.S. Provisional Application Ser. No. 62/171,796, filed Jun. 5, 2015, which is incorporated herein by reference.

BACKGROUND OF THE INVENTION

1. Field of the Background

The present invention relates generally to mattress covers having multiple joinable and exchangeable components.

2. Description of the Background

Many mattresses today are manufactured using zip on upholstery. Zip on upholstery is most commonly seen in foam mattresses but can also be used on inner-spring mattresses. The outer cover of a mattress historically is attached to a mattress by way of a sewing machine called a "tape edge machine." Zip on upholstery takes the place of the tape edge machine in a manufacturing environment. When a mattress manufacturer uses a zip on cover they do not need to do any sewing to finish the manufacture of a mattress.

An example of a zip on upholstery mattress cover 10 is seen in FIG. 1. The mattress cover 10 includes a top portion 12 and a bottom portion 14 joined along at least a portion of one end (not shown) and an opening 16 through which an internal mattress structure 18 is inserted. An integral zipper tape 20 with zipper tracks 24*a* and 24*b* bounded on both ends by the mattress cover material is secured within the opening 16 and used to seal the mattress cover 10 over the internal mattress structure 18. By pulling a zipper pull 22, the complementary zipper tracks 24*a* and 24*b* of the zipper tape 20 are joined to close the opening 16 and seal the internal mattress structure 18 within the mattress cover 10. Once the zipper tape 20 has been closed, the zipper tape is typically mechanically altered to prevent reopening, or sealed, or otherwise secured to permanently seal the mattress cover 10.

However, such mattress covers 10 present problems in the mattress industry. For example, once a mattress cover is sealed, a user cannot alter the appearance of the mattress without applying an additional mattress cover over the sealed mattress cover. This is a particular concern for mattress manufacturers that supply mattresses to competing retailers. Often, mattress retailers differentiate their product lines based on appearance, or in other words, the mattress aesthetics, rather than the internal mattress structure. For example, a mattress manufacturer may supply the same internal mattress structure to two different retailers who will market the mattress under two different brand names. In such a case, the manufacturer must make two different mattress covers: one for each retailer.

Moreover, this problem is compounded when additional mattress builds are provided to additional retailers. For example, a mattress manufacturer may provide several mattress builds to a retailer that may have internal mattress structures with different thicknesses due to differences in layers included within a particular build. Thus, for a given mattress size, such as a king, queen, single, etc., the manufacturer must use as many different mattress covers as there are different mattress thicknesses.

These problems have a significant economic impact on mattress manufacturers. Considerable material and labor costs are required to produce the different mattress covers needed. Manufacturers are required to stock a greater number of mattress stock keeping units (skus) to supply different retailers with many different mattresses. Further, additional space is needed to store the large number of skus needed, which translates into increased facility costs.

There is a need, therefore, for improved mattress covers that overcome the shortcomings in the mattress manufacturing industry.

BRIEF DESCRIPTION OF THE DRAWINGS

Other aspects and advantages of the present invention will become apparent upon reading the following detailed description and upon reference to the drawings in which.

BRIEF SUMMARY OF THE INVENTION

Figure 1:
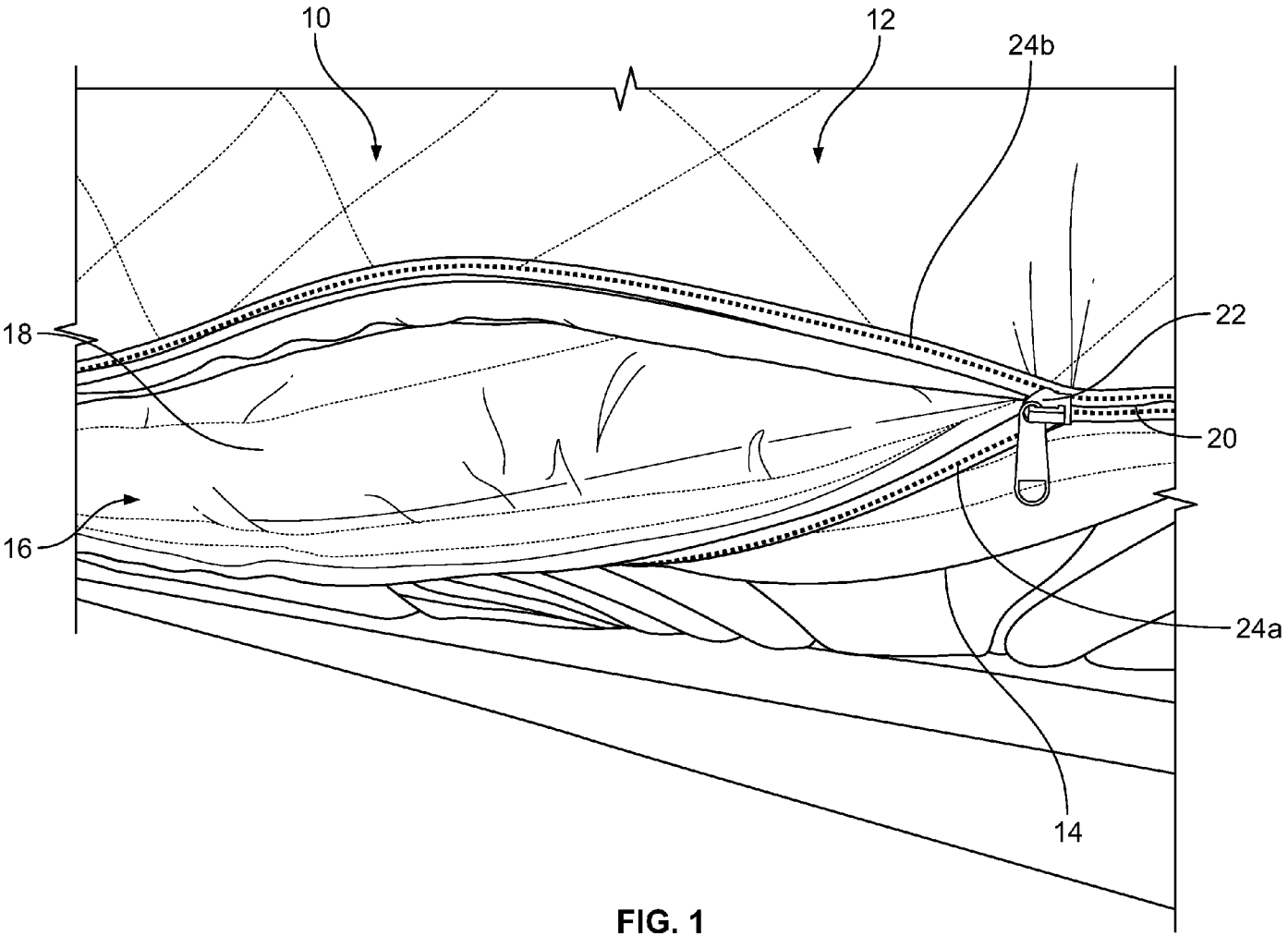
FIG. 1 (Prior Art)
FIG. 1 is a top, side perspective view of a prior art mattress cover.

According to a first aspect, a mattress cover for an internal mattress structure includes a top portion having a first zipper track, a side panel having a second zipper track and a third zipper track, and a bottom portion having a fourth zipper track. The first zipper track may be mated with the fourth zipper track to attach the top portion to the bottom portion to provide a sealed mattress cover having a first height, and the first zipper track may be mated with the second zipper track to attach the top portion to the side panel and the third zipper track may be mated with the fourth zipper track to attach the side panel to the bottom portion to provide a sealed mattress cover having a second height.

According to a second aspect, a mattress kit includes a mattress cover top portion having a first zipper track, a plurality of mattress cover side panels, each of the plurality of side panels having a second zipper track and a third zipper track, and a mattress cover bottom portion having a fourth zipper track. The first zipper track may be mated with the fourth zipper track to attach the top portion to the bottom portion to provide a sealed mattress cover having a first height. The first zipper track may be mated with the second zipper track of any of the plurality of side panels and the third zipper track of any of the plurality of side panels may be mated with the fourth zipper track to provide a sealed mattress cover having a height different from the first height.

According to a third aspect, a method of providing a distinct consumer marketing appearance to a mattress includes providing an internal mattress structure, applying a first portion of a mattress cover with a first aesthetic quality to the internal mattress structure, applying a second portion of the mattress cover with a second aesthetic quality to the internal mattress structure, and securing the first portion and the second portion to the internal mattress structure by at least one of a zipper, a hook and loop fastener, buttons, snaps, and combinations thereof to provide a distinct consumer marketing appearance to the mattress.

According to a fourth aspect, a mattress cover for an internal mattress structure includes a top portion having a first zipper track, a side panel having a second zipper track and a third zipper track, and a bottom portion having a fourth zipper track. The first zipper track may be mated with the fourth zipper track to attach the top portion to the bottom portion to provide a sealed mattress cover having a first height. The first zipper track may be mated with the second zipper track to attach the top portion to the side panel and the third zipper track may be mated with the fourth zipper track to attach the side panel to the bottom portion to provide a sealed mattress cover having a second height. In one embodiment, the first height is less than the second height. In another embodiment, the mattress cover further includes a second side panel having a fifth zipper track and a sixth zipper track. The first zipper track may be mated with the fifth zipper track to attach the top portion to the second side panel, and the sixth zipper track may be mated with the fourth zipper track to attach the second side panel to the bottom portion to provide a sealed mattress cover having a third height. The first zipper track may be mated with the second zipper track to attach the top portion to the side panel, the third zipper track may be mated with fifth zipper track to attach the side panel to the second side panel, and the sixth zipper track may be mated with the fourth zipper track to attach the second side panel to the bottom portion to provide a sealed mattress cover having a fourth height. The first zipper track may be mated with the fifth zipper track to attach the top portion to the second side panel, the sixth zipper track may be mated with the second zipper track to attach the second side panel to the side panel, and the third zipper track may be mated with the fourth zipper track to attach the side panel to the bottom portion to provide a sealed mattress cover having the fourth height. In another embodiment, the top portion has a first pattern, the side panel has a second pattern, and the bottom portion has a third pattern, and two or more of the first pattern, second pattern, and the third pattern are the same. In a further embodiment, each of the first zipper track, second zipper track, third zipper track, and fourth zipper track include tooth measured zipper tracks. In another embodiment, the tooth measured zipper tracks include a known number of zipper teeth within a specific section of the zipper tracks demarcated by indicia on the zipper tracks. In a further embodiment, the top portion, side panel, and bottom portion each comprises edges having notches to which indicia on the zipper tracks are aligned. In one embodiment, the top portion, side panel, and bottom portion are interchangeable with top portions, side panels, and bottom portions of other mattress covers for the same size mattress.

In a fifth aspect, a mattress cover includes a mattress cover top portion having a first zipper track of a tooth measured zipper, and a mattress cover bottom portion having a second zipper track of the tooth measured zipper. The first zipper track may be mated with the second zipper track to attach the top portion to the bottom portion to provide a sealed mattress cover, and the first zipper track and the second zipper track comprise a hidden zipper. In one embodiment, the top portion differs from the bottom portion by at least one of material, height, color, pattern, texture, or a combination thereof. In another embodiment, the hidden zipper includes piping attached to the zipper tracks with about 4-5 stitches per inch. In a further embodiment, at least one of the mattress cover top portion and the mattress cover bottom portion includes a pretreated edge. In another embodiment, the pretreated edge includes at least one of a cleaned edge or an overlocked edge. In one embodiment, the pretreated edge includes a stiffening agent. In a further aspect, a kit includes the mattress cover described above.

In a sixth aspect, a method of providing a distinct consumer marketing appearance to a mattress includes providing an internal mattress structure, applying a first portion of a mattress cover with a first aesthetic quality to the internal mattress structure, applying a second portion of the mattress cover with a second aesthetic quality to the internal mattress structure, and securing the first portion and the second portion to the internal mattress structure by at least one of a zipper, a hidden zipper, a hook and loop fastener, buttons, snaps, and combinations thereof to provide a distinct consumer marketing appearance to the mattress. In one embodiment, the method further includes applying a third portion of a mattress cover having a third aesthetic quality to the internal mattress structure. In one embodiment, the first portion, the second portion, and the third portion of the mattress cover are secured together to seal the internal mattress structure within the mattress cover. In a further embodiment, the third portion includes at least one of a zipper, a hidden zipper, a hook and loop fastener, buttons, snaps, and combinations thereof. In a further embodiment, the secured first portion and second portion have a properly tailored appearance. In another embodiment, the internal mattress structure includes multiple layers.

DETAILED DESCRIPTION OF THE INVENTION

All publications, patents and patent applications cited herein are hereby expressly incorporated by reference in their entirety for all purposes.

Before describing the present invention in detail, a number of terms will be defined. As used herein, the singular forms "a," "an," and "the" include plural referents unless the context clearly dictates otherwise. For example, reference to "a stiffening agent" means one or more stiffening agents.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that can or cannot be utilized in a particular embodiment of the present invention.

For the purposes of describing and defining the present invention it is noted that the term "substantially" is utilized herein to represent the inherent degree of uncertainty that can be attributed to any quantitative comparison, value, measurement, or other representation. The term "substantially" is also utilized herein to represent the degree by which a quantitative representation can vary from a stated reference without resulting in a change in the basic function of the subject matter at issue.

As used herein, the term "about" refers to ±10% of any particular value.

As used herein, the terms "or" and "and/or" are utilized to describe multiple components in combination or exclusive of one another. For example, "x, y, and/or z" can refer to "x" alone, "y" alone, "z" alone, "x, y, and z," "(x and y) or z," "x or (y and z)," or "x or y or z."

As used herein, the term "properly tailored appearance" refers to the appearance of a mattress cover installed on a mattress that appears to be properly sized for the mattress and is without overly stretched areas, sagging, or wrinkles.

Figure 2:
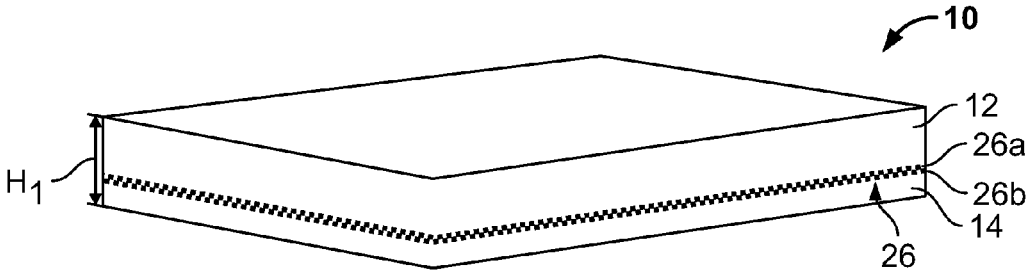
FIG. 2 is a top, side, front perspective view of a mattress cover according to one embodiment.
Figure 3:
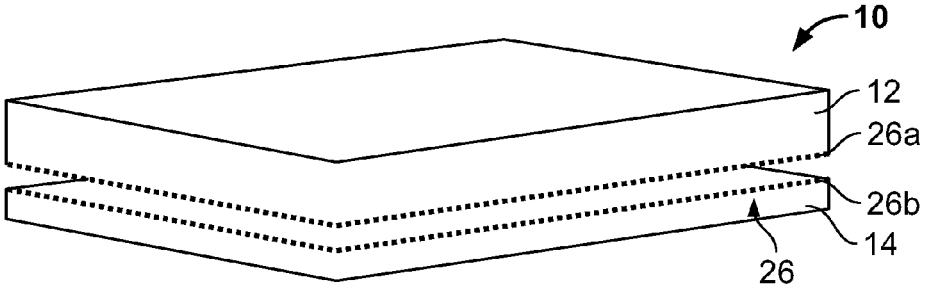
FIG. 3 is a top, side, front perspective view of the mattress cover of FIG. 2 in an open state.

As seen in FIGS. 2-10 and 12-14, the present disclosure is directed to mattress covers 10 that overcome the limitations of the prior art. In one possible form seen in FIGS. 2 and 3, a mattress cover 10 includes a top portion 12 and a bottom portion 14 that are joined by a non-integral zipper 26. Non-integral zippers when unzipped allow complete separation of the zipper tracks from one another. Here, unlike the prior art, the joining of zipper tracks 26*a* and 26*b* alone attaches the top portion 12 to the bottom portion 14. Thus, the zipper tracks 26*a* and 26*b* extend the length of the periphery of the mattress cover 10, and when the zipper 26 is unzipped, the top portion 12 and bottom portion 14 may be separated from one another. When the zipper tracks 26*a* and 26*b* are mated and the zipper closed, as seen in FIG. 2, the mattress cover 10 has a first height $H_1$.

Figure 4:
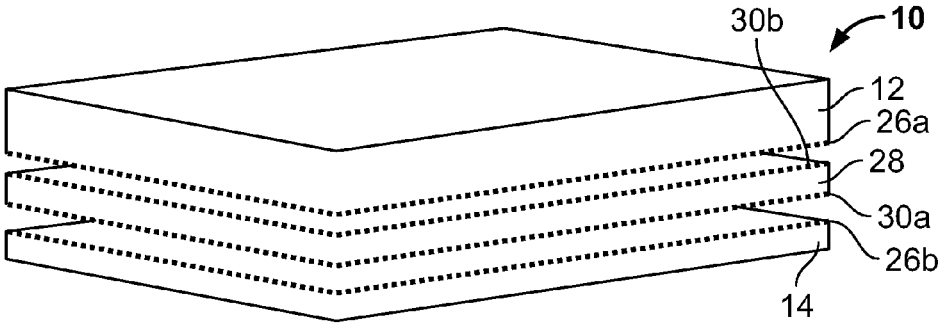
FIG. 4 is a top, side, front perspective view of the mattress cover of FIG. 2 in an open state with an added side panel.
Figure 5:
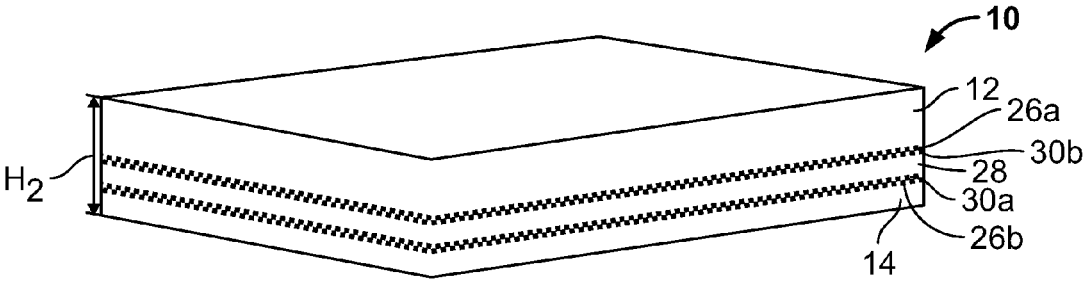
FIG. 5 is a top, side, front perspective view the mattress cover of FIG. 4 in an assembled state.
Figure 6:
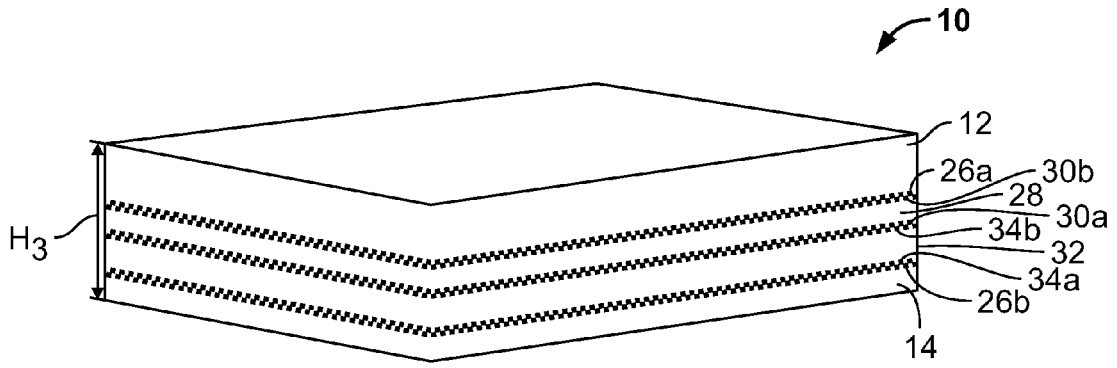
FIG. 6 is a top, side, front perspective view of a mattress cover according to another embodiment.
Figure 7:
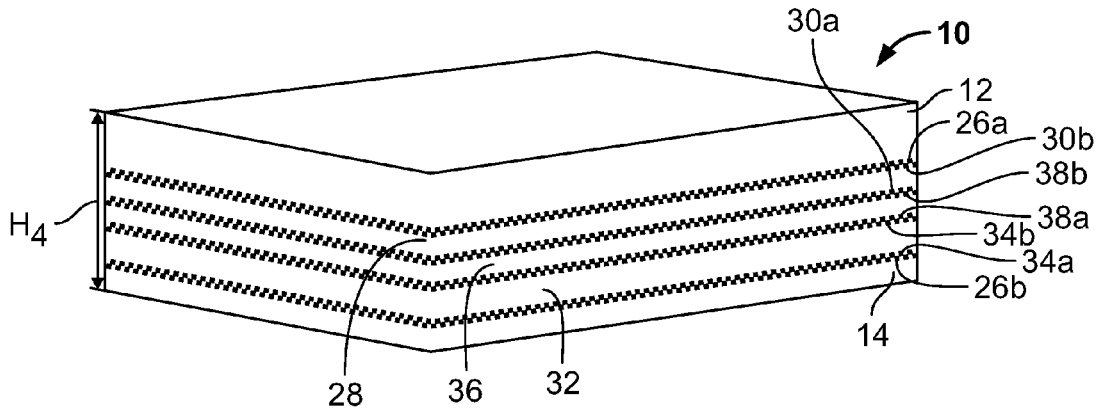
FIG. 7 is a top, side, front perspective view of a mattress cover according to a further embodiment.

As shown in FIGS. 4 and 5, mattress covers 10 of the present disclosure are adaptable, in that, they may be enlarged by adding a side panel 28 with zipper tracks 30*a* and 30*b* that are complementary with zipper tracks 26*b* and 26*a*, respectively. Addition of the side panel 28 renders a mattress cover 10 with a height $H_2$ that is greater than $H_1$. Moreover, as seen in FIGS. 6 and 7, a plurality of side panels 28, 32, and 36 may be combined together into a single mattress cover 10 to accommodate internal mattress structures corresponding to heights $H_3$ (with side panels 28 and 32) and $H_4$ (with side panels 28, 32, and 36). Side panel 32 includes zipper tracks 34*a* and 34*b*, which are complementary to those of adjacent tracks below and above, respectively. Similarly, side panel 36 includes zipper tracks 38*a* and 38*b*, which are complementary to those of adjacent zipper tracks below and above, respectively. Further, different side panels 28, 32, and 36 may have different heights and may be used interchangeably. Thus, by combining side panels with different heights and including any number of side panels, mattress covers 10 may be assembled to have any height.

Mattress covers 10 of the present disclosure are designed to have a tight fit on a matched inner mattress structure, such that when a mattress cover is placed on a matching internal mattress structure and the zippers are closed, the mattress cover neatly fits on the internal mattress structure 18 to provide a properly tailored appearance without sagging or wrinkles.

Another advantage of the mattress covers 10 of the present disclosure is that they allow mattress manufacturers to differentiate their mattresses in the market based on appearance rather than solely the internal mattress structure 18. Therefore, a mattress manufacturer may supply the same internal mattress structure 18 to two different retailers who will market the internal mattress structure under two different brand names each having a distinct marketing appearance based on the aesthetic qualities of the specific mattress cover. There is no need to make two completely different mattress covers in this case. The manufacturer may simply use a different side panel or combination of top and bottom portions to distinguish one brand from another.

Figure 8:
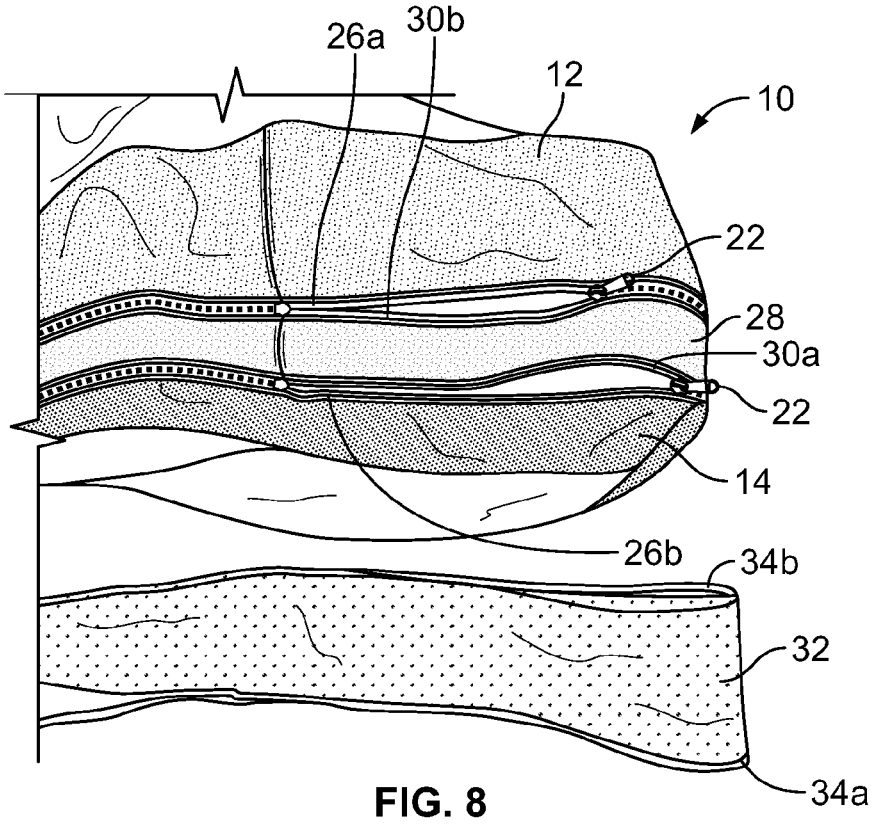
FIG. 8 is a side elevational view of a mattress cover similar to that of FIG. 6 in a partially disassembled state.
Figure 9:
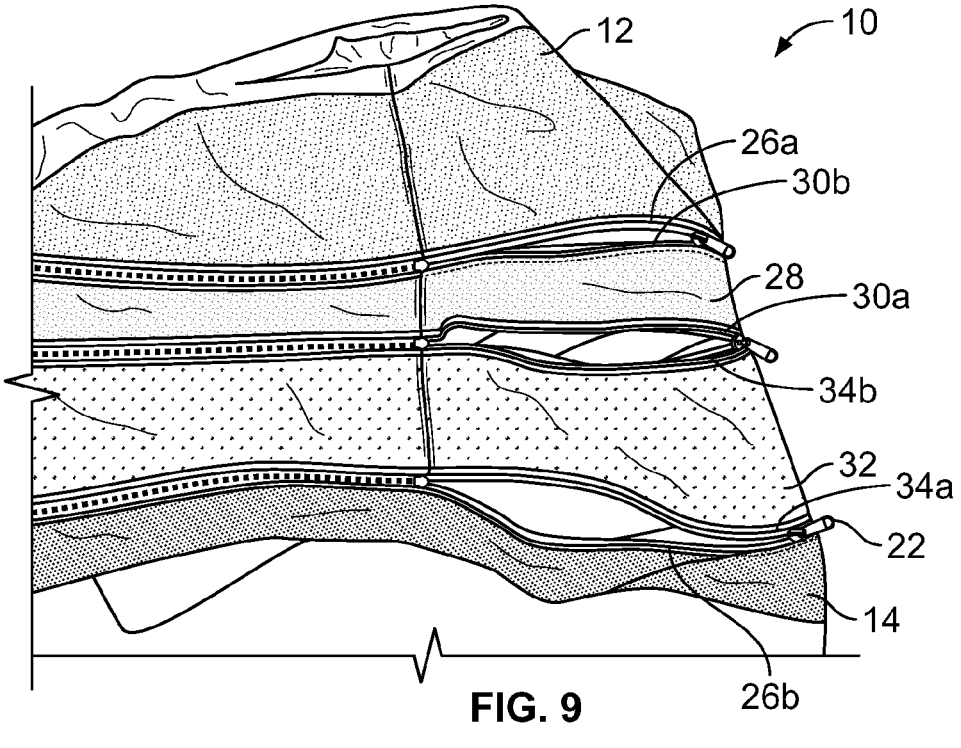
FIG. 9 is a side elevational view of the mattress cover of FIG. 8 in a partially assembled state.
Figure 10:
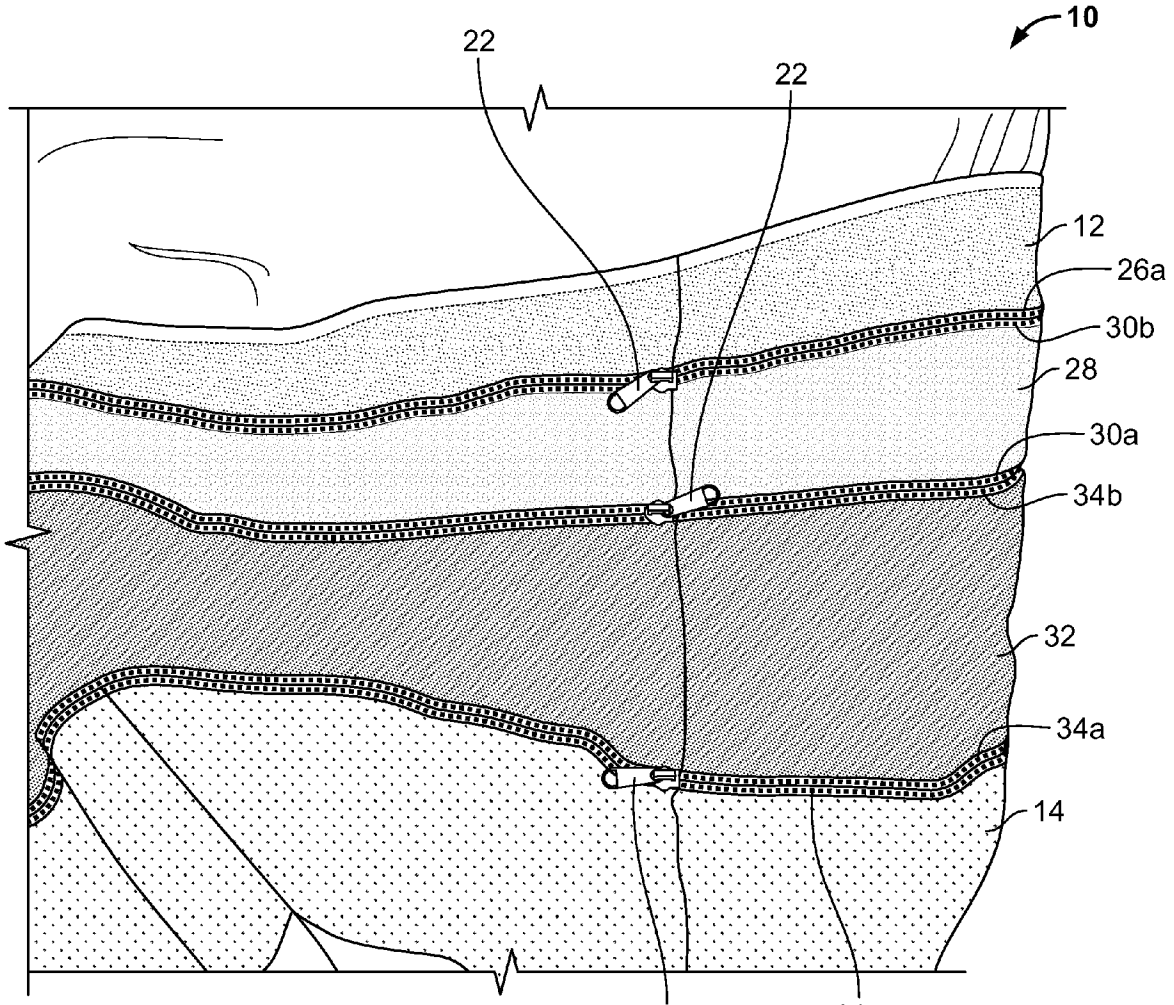
FIG. 10 is a side elevational view of a mattress cover according to another embodiment.

Mattress covers 10 of the present disclosure may have distinct aesthetic appearances by including any pattern or texture or combinations of patterns and/or textures and colors in the individual mattress cover components. Examples of mattress covers 10 made of components with distinct aesthetic appearances due to using different materials and/or having different textures and colors are seen in FIGS. 8-10. Indeed, the mattress covers 10 of FIGS. 8-10 demonstrate how mattress covers of the present disclosure can be used to generate different mattress appearances that can be separately marketed to consumers. Such consumer marketing appearances enable consumers to identify specific brands and products lines.

The modular nature of the mattress covers 10 described herein allows additional variations, such as including a top portion 12 made from a liquid or stain resilient material, including a cushion top, having a quilted appearance, engineered panels, cooling fabric, natural fibers, and specialty treatments known in the industry. Further, the bottom portion 14 may have a non-skid quality or may be made from a breathable fabric, a woven or knit fabric, or a flame resistant fabric. Still further, the different components of the mattress cover may be made of different materials to save cost. Moreover, side panels 28, 32, 36 may be chosen based on different qualities aside from aesthetic appearance, such as flame resistant fabric, branded fabric, breathable fabric, heat wicking qualities, and the like. Zippers that may be used include nylon, coil, molded plastic matched tooth zippers, and the like. Further, as an alternative to zippers (or in addition to) hook and loop fasteners, buttons, snaps, and combinations thereof, may be used in the present invention. Mattress covers 10 can be made for any size mattress and/or box spring. In one embodiment, a mattress cover 10 is sized to cover both a mattress and a box spring.

In another embodiment, mattress covers 10 of the present disclosure allow mattress retailers to change out the top portion of the mattress cover on their floor samples thereby refreshing the appearance of their mattresses. For example, mattress floor samples are an expensive part of merchandising for mattress manufactures. Consumers are encouraged to lie on mattresses to discover if the feel is to their liking. Because of this, the textile covers on floor samples eventually become visually undesirable and must be replaced. Normally, the entire mattress gets replaced and discarded. This product allows the retailer to replace the top portion (and optionally one or more side portions, as desired) of the cover 10 without having to replace the entire unit. The result is substantial cost savings.

Figure 11A:
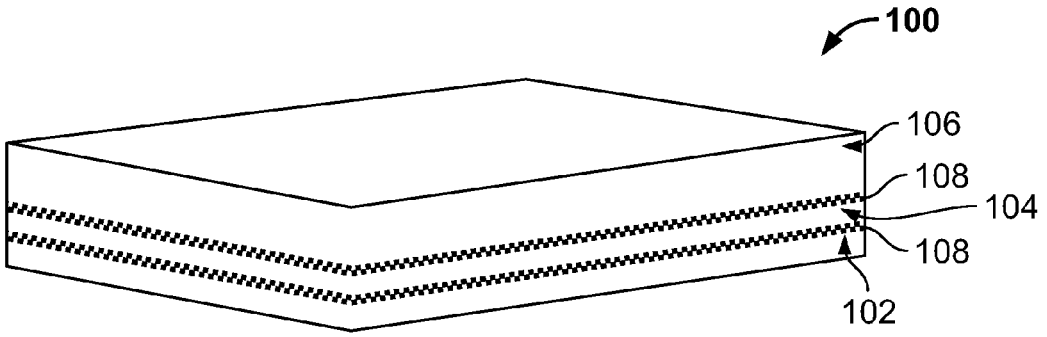
FIG. 11A is a top, side, front perspective view of an internal mattress structure according to one embodiment.

In another embodiment, mattress covers 10 of the present disclosure may allow a user to modify a build of the mattress. For example, as seen in FIG. 11A, an internal mattress structure 100 may be provided with a bottom layer 102, a middle layer 104, and a top layer 106 that correspond in relative dimensions to the mattress cover components 14, 28, and 12, respectively, of FIG. 4. Rather than the layers 102, 104, 16 being permanently joined together as in conventional mattresses, the layers may be reversibly secured to each other such as by hook and loop fasteners 108 on top and bottom surfaces thereof, or other mechanical closure means, pressure sensitive adhesives, other adhesives, and combinations thereof. In other words, the layers 102, 104, and 106 of the internal mattress structure 100 may be interchangeable and/or rearrangeable (e.g., a user may reorganize the order of layers and/or the turn one or more layers 180 degrees) with respect to each other. Without wishing to be bound by theory, it is believed that the interchangeability and rearrangeability of the separate mattress layers with respect to one another will prolong use of the mattress by permitting a more even wearing of the layers during the life of the mattress.

Figure 11B:
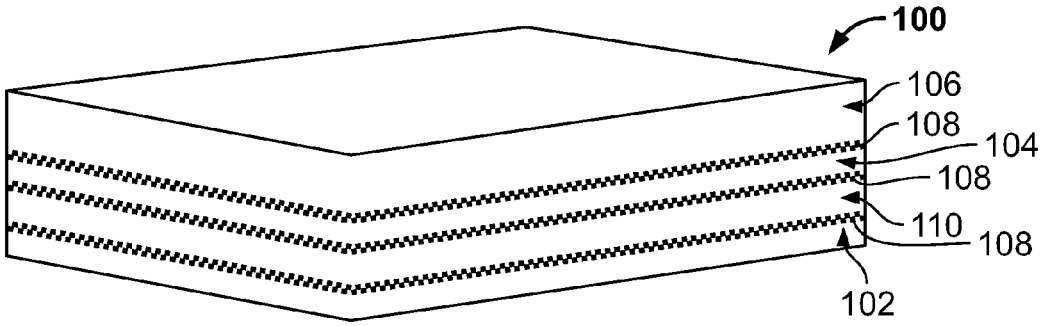
FIG. 11B is a top, side, front perspective view of an internal mattress structure according to another embodiment.
Figure 11C:
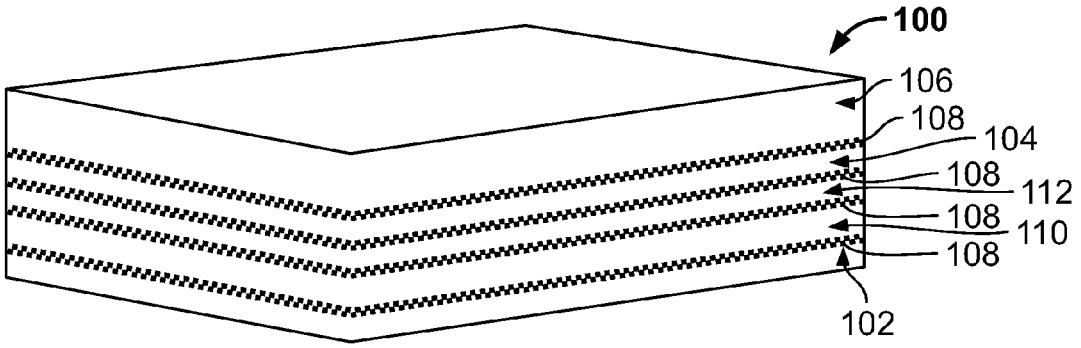
FIG. 11C is a top, side, front perspective view of an internal mattress structure according to a further embodiment.

Further, as seen in FIGS. 11B and 11C, additional layers 110 and 112 may be added later to allow the user to further modify the internal mattress structure 100. Conversely, a user may purchase a mattress with an internal mattress structure 100 having multiple internal layers 104, 110, and 112, as seen for example in FIG. 11C and then modify the internal mattress structure by removing one or more internal layers 110 and 112 to have a shorter internal mattress structure like that seen in FIG. 11A. Still further, it is envisioned that separate internal mattress structures 100 from different mattresses of the same size could be combined, such that their individual components could be exchanged to create new internal mattress structures. Any number of layers is envisioned for the internal mattress structures discussed above.

In one embodiment that combines the mattress cover 10 of FIG. 4 and the internal mattress structure 100 of FIG. 11A, in practice, a user may modify the internal mattress structure by removing the middle layer 104, attaching the bottom layer 102 to the top layer 106, and then modifying the mattress cover by removing the side panel 28 and attaching the top portion 12 to the bottom portion 14 to obtain the correct fit for the mattress cover when placed on the modified internal mattress structure. In this way and in other similar ways, mattress covers 10 and mattress structures 100 may be appropriately paired to provide one or more systems that allow for modifications to a mattress by a retailer and/or end user.

It is further envisioned that a mattress cover kit may be supplied that includes a top portion 12, bottom portion 14, and one or more side panels 28, 32, and 36. Similarly, a mattress kit may be supplied that includes an internal mattress structure 100 having a plurality of layers (102, 104, 106, etc.) and a mattress cover 10 including a plurality of portions 14, 28, 12, etc.). The mattress cover 10 would be sized to fit the internal mattress structure 100 provided with the kit. The kit would be compatible with additional kits having alternate or additional side panels for the mattress cover 10 and also with additional structural layers. In this way, by combining two or more kits, the end user may construct their own mattress build and decide what appearance it will have in a dynamic or otherwise variable way.

Mattress Cover Assembly

For mattress cover portions to be interchangeable, e.g., such that a top portion from a first mattress cover can be replaced with a top portion from a second mattress cover to create an aesthetically desirable, newly combined mattress cover, each mattress cover portion must be carefully constructed. This is particularly true when manufacturing thousands of mattress covers and each portion from each mattress cover must be interchangeable with any other equivalent and/or compatible mattress cover portion (e.g., top portions for top portions, side panels for side panels, and bottom portions for bottom portions for a given size of mattress cover). Importantly, the zipper tracks from each mattress cover portion must be functionally compatible with those of other portions. For example, the zipper tracks must be the same length and start at a compatibly acceptable position such that the separate zipper tracks can be zipped together to provide a mattress cover with a properly tailored appearance. Further, the attachment of the zipper track to the mattress cover portion, such as by sewing, must not skew or non-uniformly alter the length of the mattress cover material nor alter the length of the zipper track itself.

To create interchangeable mattress cover portions, each mattress cover portion should be nearly uniform in perimeter length and shape with the portion with which it will be interchanged, though it may vary in height. Because mattress cover materials can have some degree of elasticity, slight differences in perimeter length between portions will not make an aesthetic difference when the mattress cover is assembled. However, there is little to no room for error with the zipper tracks because zipper teeth must match up or either the zipper tracks will not properly mesh or the lengths of each zipper track section will differ resulting in an unacceptable product.

Figure 12:
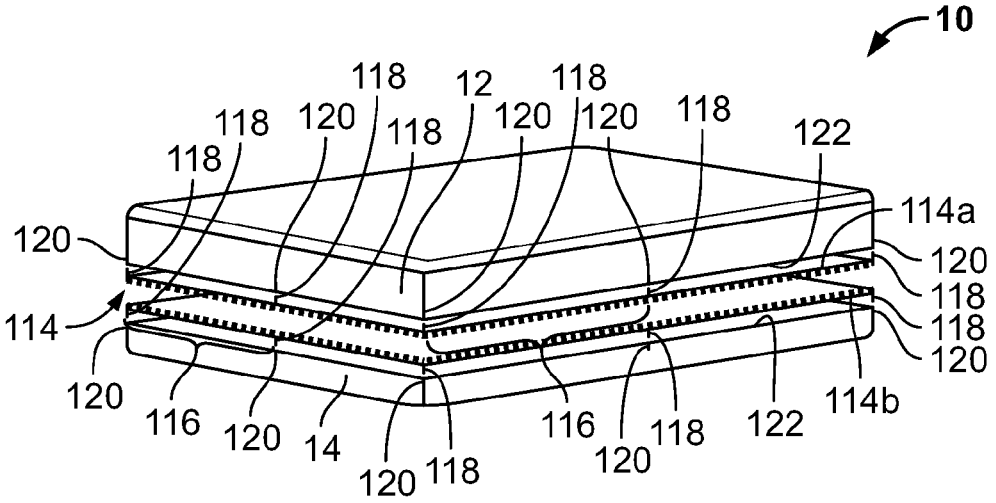
FIG. 12 is a top, side, front perspective view of a mattress cover according to one embodiment similar to that shown in FIGS. 2 and 3 in a disassembled state and illustrating guides for assembly of the mattress cover.
Figure 13:
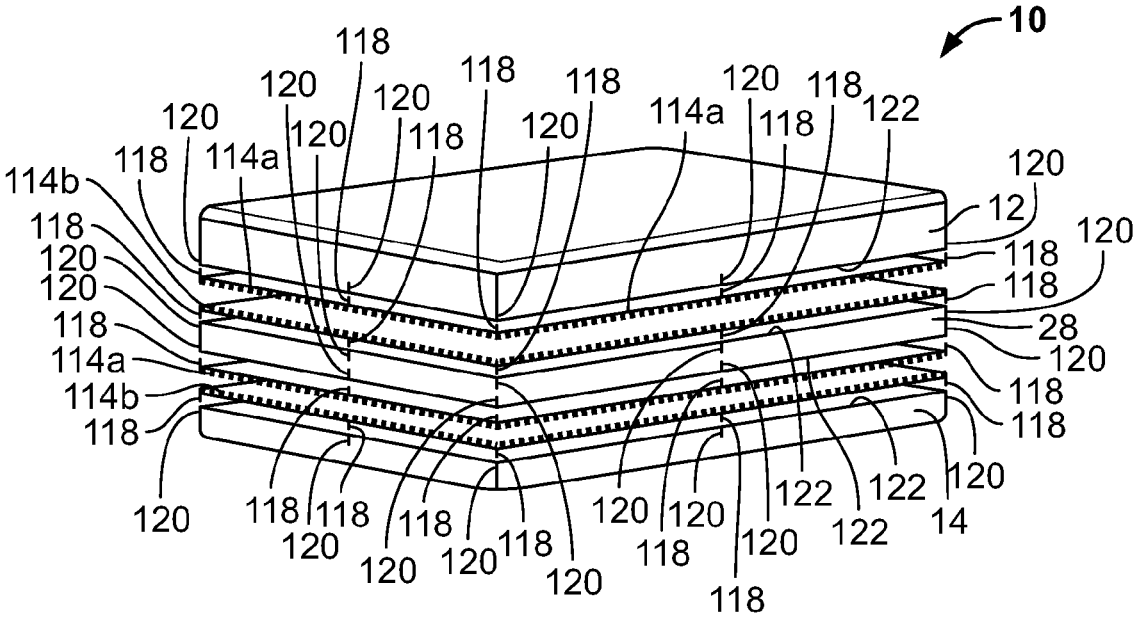
FIG. 13 is a top, side, front perspective view of a mattress cover according to another embodiment similar to that shown in FIG. 4 in a disassembled state and illustrating guides for assembly of the mattress cover.
Figure 14:
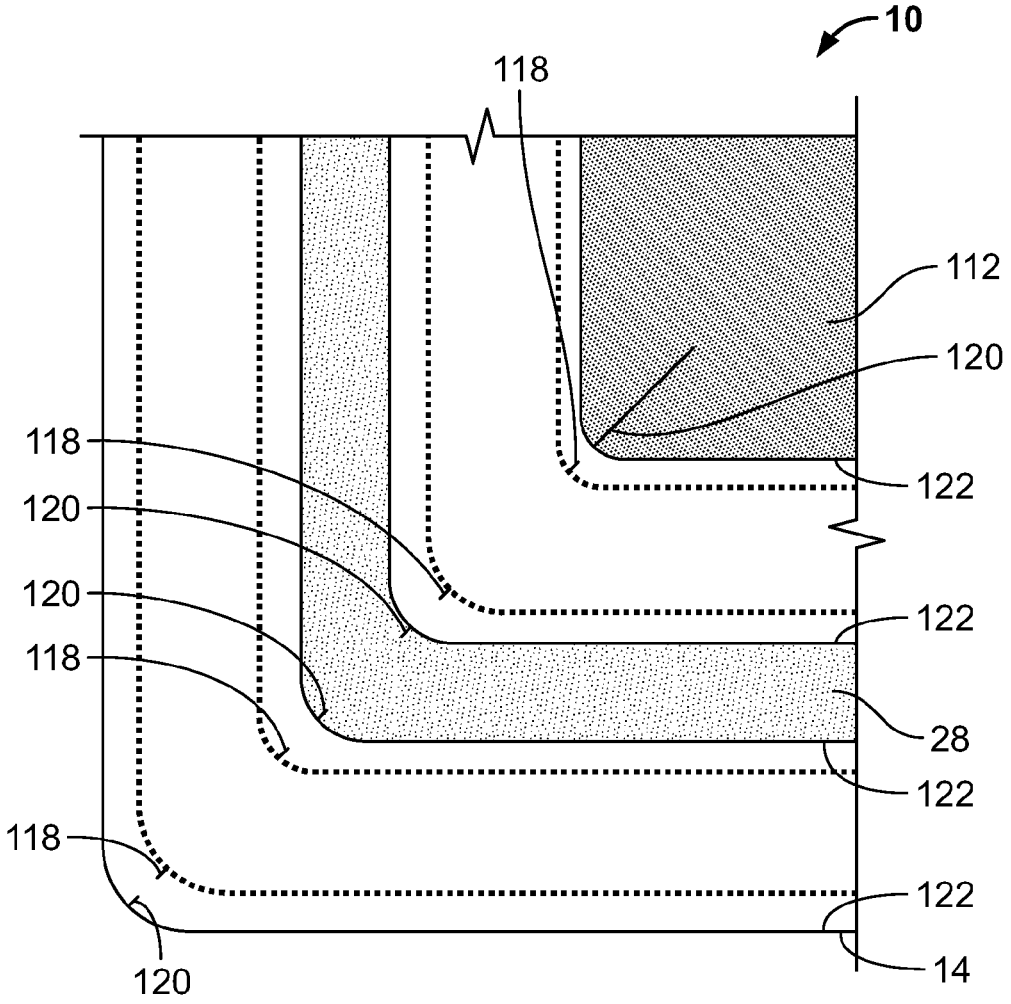
FIG. 14 is a partial top plan view of the mattress cover of FIG. 13.

As shown in FIGS. 12-14, one approach to achieving interchangeability of mattress cover portions is to use a tooth measured zipper 114 that has a known number of zipper teeth within a specific section 116 of zipper track demarcated by indicia 118 on the zipper tracks. Any type of indicia is contemplated. Further, each track 114*a*, 114*b* of the zipper 114 has the same or a complementary number of teeth between corresponding indicia 118 within corresponding sections 116. Next, notches (or other indicia) 120 are made at specific locations on the mattress cover portion 12, 14, 28 at the edges 122 to which a zipper track 114*a* or 114*b* is to be attached. The notches 120 can be placed, for example, at each corner seam and midway along each side. Though, more or fewer notches 120 may be used. Further, the notches 120 on each mattress cover portion 12, 14, 28 at a specific location align with those on other portions 12, 14, 28 of the same mattress cover (or of other covers of the same size) in the same specific location. For example, corner notches align vertically with corner notches and side notches align vertically with side notches (see FIGS. 12 and 13). Finally, each zipper track 114*a*, 114*b* is attached to each corresponding mattress cover portion edge 122 while aligning indicia 118 from the zipper track with notches 120 on the mattress cover portion, which aligns corresponding sections 116 of zipper tracks between mattress cover portions. By aligning the indicia 118 with the notches 120 for each portion, interchangeability of mattress cover portions is achieved, because each section 116 of zipper track 114*a* or 114*b* from a first mattress cover portion 12, 14, 28, will have the same number of teeth as an equivalent section of zipper track of another mattress cover portion. Therefore, the zipper tracks 114*a*, 114*b* will be able to zip together and properly mesh.

In another embodiment, greater consistency in manufacturing is achieved by preparing the mattress cover material by pretreating the edges 122, for example, by "cleaning" or "overlocking," to add additional rigidity to the material, which helps to reduce skewing of the material during attachment of the zipper track 114*a*, 114*b* to the edges. In a further embodiment, the edges 122 of the mattress cover material may be pretreated prior to mattress cover assembly by adding a stiffening agent to the material that serves to reduce elasticity of the material and minimize skewing during mattress cover assembly. Contemplated stiffening agents include any compound or material that can be used to reduce the elasticity of the mattress cover material, such as, for example, starch, a gel, an adhesive, a viscous liquid, etc. Further, any other approaches that can be used to reduce the elasticity of the mattress cover material along the edges 122 are contemplated herein, such as the addition of an additional piece of material or a hem to the edge, heat welding the material along the edge, or freezing the material at the time of assembly, etc. It is also contemplated that combinations of these approaches or others that reduce elasticity of the mattress cover material can be used.

Piping Assembly

Figure 15:
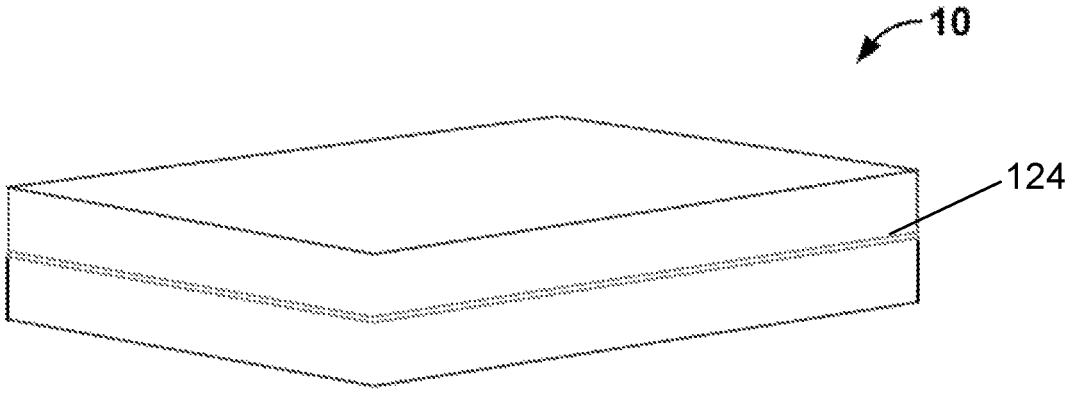
FIG. 15 is a top, side, front perspective view of a hidden zipper mattress cover according to one embodiment.

In a further embodiment seen in FIG. 15, mattress covers 10 can be assembled with piping 124 added to hide the zippers to create "hidden zipper" mattress covers. Piping 124 can be constructed of rope, cord, plastic or metal wire, or similar material wrapped or covered with a piece fabric, ribbon, or other material. However, adding piping to zippers creates another significant obstacle to producing interchangeable mattress cover portions because sewing piping to a zipper affects the zipper's overall length by causing shrinkage. This, in turn, increases the chances for producing incompatible mattress cover portions because shrinkage is difficult to control and can lead to inconsistent zipper lengths. However, it has now been found that preassembly of piping and zipper sections before attaching the zippers to the mattress cover portions avoids this problem.

In one embodiment, by using an automated stitching process, preassembly of piping and zippers can be achieved while minimizing zipper shrinkage by controlling the tension applied to the piping materials and zipper being sewn together. For example, in the automated stitching process, before the piping is sewn to the zipper, the tension of the piping being fed into the stitching machine (e.g., a semi-automatic multi needle chainstitch machine) is balanced with that of the zipper tape simultaneously being fed into the machine. In addition, the tension of the joined piping and zipper tape being fed out of the machine is also controlled to minimize any stretching (by pulling too quickly) or bunching (by pulling too slowly) of the joined materials.

In another embodiment, a further approach to minimizing zipper shrinkage is to use a specific number of stitches per inch (SPI) when sewing the piping materials to the zipper. As SPI increases, zipper shrinkage increases, however, if SPI is too low, the quality of the product is unsatisfactory because the piping can pull away from the zipper during use of the mattress cover 10. It has been found that by using about 4-5 SPI, zipper shrinkage is minimized but the quality of the end mattress cover is excellent.

A further impediment to interchangeability of mattress cover portions was discovered by adding piping to one zipper track at a time. This assembly approach led to instances where one zipper track varied in length compared to its complementary track. This problem was solved by attaching piping to both tracks of the zipper (i.e., box and pull tracks) at the same time while the zipper tracks are zipped together. This approach assures compatibility of the "hidden zipper" tracks produced because each track is exposed to the same tension at the same time during the piping process and while zipped together. Therefore, each track experiences the same shrinking and/or stretching as the other throughout the piping assembly process to minimize variations between the tracks. Prior to construction of mattress cover portions, as described above in reference to FIGS. 12-14, the hidden zipper tracks are separated to allow separate attachment of each zipper track to corresponding or mating edges 122 of mattress cover portions.

INDUSTRIAL APPLICABILITY

Mattress covers described herein include one or more replaceable portions to provide variability in mattress appearance and adaptability of mattress covers to different mattresses.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the application are reserved.

What is claimed is:

1. A mattress cover, comprising:

a mattress cover top portion having a first zipper track of a tooth measured zipper, wherein the tooth measured zipper includes a known number of zipper teeth within a specific section of the first zipper track that is demarcated by indicia on the first zipper track, and wherein an edge of the mattress cover top portion includes indicia that align with the indicia on the first zipper track; and a mattress cover bottom portion having a second zipper track of the tooth measured zipper, wherein the first zipper track is configured to be mated with the second zipper track to attach the top portion to the bottom portion to provide a sealed mattress cover.

2. The mattress cover of claim 1, wherein the top portion differs from the bottom portion by at least one of material, height, color, pattern, texture, or a combination thereof.

3. The mattress cover of claim 1, wherein the first zipper track and the second zipper track comprise a hidden zipper comprising piping attached to the zipper tracks.

4. The mattress cover of claim 1, wherein at least one of the mattress cover top portion and the mattress cover bottom portion comprises a pretreated edge.

5. The mattress cover of claim 4, wherein the pretreated edge comprises at least one of a cleaned edge or an overlocked edge.

6. The mattress cover of claim 4, wherein the pretreated edge comprises a stiffening agent.

7. A kit comprising the mattress cover of claim 1 and at least one additional mattress cover top portion.

8. The mattress cover of claim 1, wherein the first zipper track and the second zipper track comprise a hidden zipper.

9. The mattress cover of claim 1, wherein the tooth measured zipper includes a known number of zipper teeth within a specific section of the second zipper track that is demarcated by indicia on the second zipper track.

10. The mattress cover of claim 1 further comprising:

a side panel having a third zipper track and a fourth zipper track, wherein the first zipper track is configured to be mated with the third zipper track to attach the top portion to the side panel and the second zipper track is configured to be mated with the fourth zipper track to attach the side panel to the bottom portion to provide a sealed mattress cover.

11. The mattress cover of claim 1, wherein the mattress cover top portion is interchangeable with top portions of other mattress covers for the same size mattress.

* * * * *